US010455964B1

(12) United States Patent
LaRue

(10) Patent No.: US 10,455,964 B1
(45) Date of Patent: Oct. 29, 2019

(54) EXTENDED SHOEHORN DEVICE

(71) Applicant: Len LaRue, Reno, NV (US)

(72) Inventor: Len LaRue, Reno, NV (US)

( * ) Notice: Subject to any disclaimer, the term of this patent is extended or adjusted under 35 U.S.C. 154(b) by 45 days.

(21) Appl. No.: 14/657,784

(22) Filed: Mar. 13, 2015

Related U.S. Application Data

(60) Provisional application No. 61/995,691, filed on Apr. 18, 2014.

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82; A43B 11/02; A43C 13/02; A45B 3/00
USPC ..... D2/642
See application file for complete search history.

(56) References Cited

U.S. PATENT DOCUMENTS 466,643 A * 1/1892 Wolf ..... A47G 25/82 223/119
470,109 A * 3/1892 Dickinson ..... A47G 25/82 223/119
594,894 A * 12/1897 Nylander ..... A47G 25/82 223/118
1,238,432 A * 8/1917 Orr ..... A47G 25/82 223/119
1,374,544 A * 4/1921 Asplund ..... A47G 25/82 223/119
1,668,262 A * 5/1928 Bingaman ..... B67B 7/44 7/123
2,939,618 A * 6/1960 Mangels ..... A47G 25/80 223/113
3,088,639 A * 5/1963 Sexton ..... A47G 25/82 223/118
3,410,463 A * 11/1968 Carlos ..... A47G 25/82 223/119
5,655,693 A * 8/1997 Engelman ..... A47G 25/82 223/118
6,695,182 B1 * 2/2004 Shrewsbury ..... A47G 25/82 223/113
D640,039 S * 6/2011 Szymanski ..... D2/642
8,215,524 B1 * 7/2012 Swisher ..... A47G 25/82 223/111

FOREIGN PATENT DOCUMENTS

DE 202011050212 * 7/2011

* cited by examiner

*Primary Examiner* — Ismael Izaguirre
(74) *Attorney, Agent, or Firm* — Quickpatents, LLC; Kevin Prince

(57) ABSTRACT

Disclosed herein is a shoehorn device, made for right handed or left handed users, having a long offset handle allowing the user to use the shoehorn in front of the user with good visualization. The shoehorn straddles the back of the shoe allowing the user to slip into their shoes while in front of the user. The offset handle is either mounted on the right side or the left side depending on the user. The device is useful for anyone who may desire to put on their shoes with a shoehorn in a standing position or a sitting position without having to bend forward. The device may be particularly useful for people with physical conditions, impairments, or disabilities that make bending over or otherwise reaching for their shoes difficult. The invention helps those who have difficulties inserting their feet into their shoes. The shoehorn has an attached offset long vertical handle.

13 Claims, 8 Drawing Sheets

EXTENDED SHOEHORN DEVICE

CROSS-REFERENCE TO RELATED APPLICATIONS & CONTINUITY DATA

This application claims the benefit of provisional application 61/995,691 filed Apr. 18, 2014, hereby incorporated by reference in its entirety.

STATEMENT REGARDING FEDERALLY SPONSORED RESEARCH OR DEVELOPMENT

N/A

REFERENCE TO SEQUENTIAL LISTING, A TABLE, OR A COMPUTER PROGRAM LISTING APPENDIX SUBMITTED ON A COMPACT DISC

N/A

BACKGROUND OF THE INVENTION

Many individuals have medical impairments, injuries, or other physical limitations that make difficult to bend over, sit and bend over simultaneously, or otherwise reach their shoes. The device herein is useful for anyone who may desire to put on their shoes with a shoehorn in a standing position or a sitting position without having to bend forward. The device may be particularly useful for people with physical conditions, impairments, or disabilities that make bending over or otherwise reaching for their shoes difficult.

FIELD OF THE INVENTION

The invention relates to shoe related accessories.

SUMMARY OF THE INVENTION

Disclosed herein is a shoehorn device, made for right handed or left handed users, having a long offset handle allowing the user to use the shoehorn in front of the user with good visualization. The shoehorn straddles the back of the shoe allowing the user to slip into their shoes while in front of the user. The offset handle is either mounted on the right side or the left side depending on the user. The device is useful for anyone who may desire to put on their shoes with a shoehorn in a standing position or a sitting position without having to bend forward. The device may be particularly useful for people with physical conditions, impairments, or disabilities that make bending over or otherwise reaching for their shoes difficult.

The invention helps those who have difficulties inserting their feet into their shoes. The shoehorn has an attached offset long vertical handle. The offset handle can be mounted on the right side or the left side depending on either a right or left handed user. This allows the user to use the shoehorn in front of you. The long handle allows the user to stand. The offset allows for better visualization and less body movement. The wide saddle of the shoehorn makes it easy to maneuver over the back portion of the shoe. The back tab holds the back of the shoe while the front slide guide is inserted over the heel portion of the shoe making it easy to slide your foot into the shoe.

BRIEF DESCRIPTION OF THE DRAWINGS FIGURES

FIG. 4 is particularly included however to show the contour and shape of the two tongue like devices, A and B.

DETAILED DESCRIPTION OF THE PREFERRED EMBODIMENTS

Figure 1:
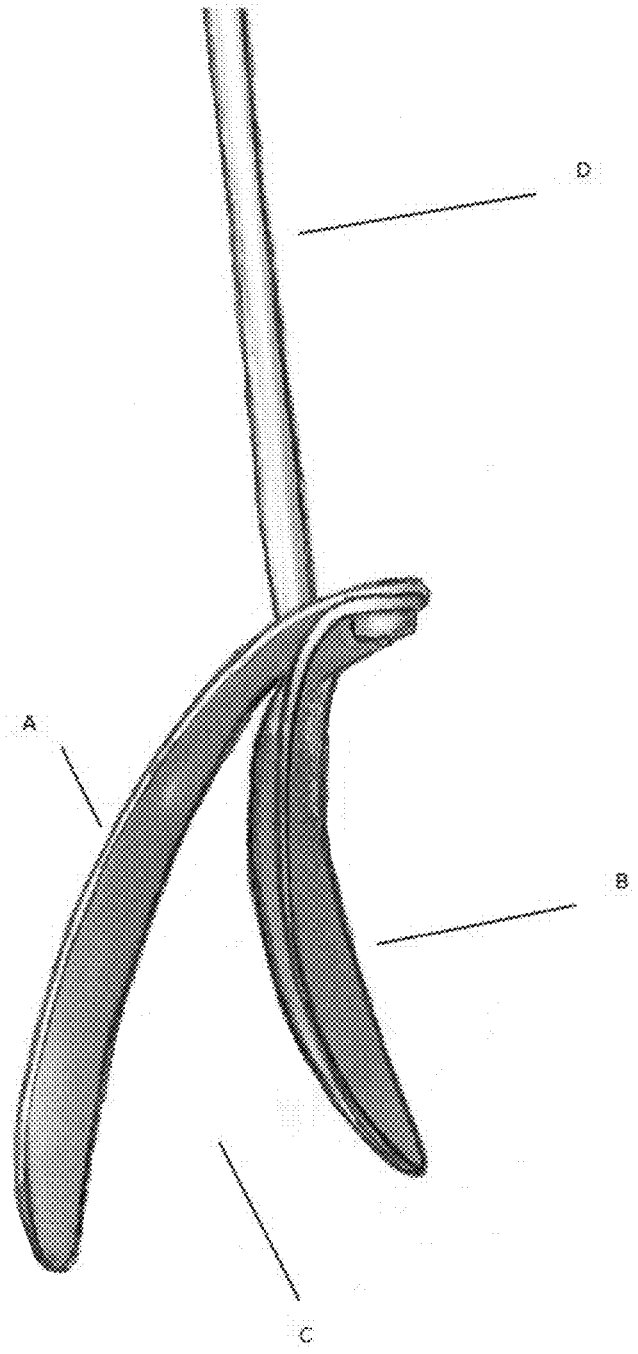
FIG. 1 shows a side view of the lower portion of the device.

Disclosed herein is a shoehorn device, made for right handed or left handed users, having a long offset handle allowing the user to use the shoehorn in front of the user with good visualization. The shoehorn straddles the back of the shoe allowing the user to slip into their shoes while in front of the user. The offset handle is either mounted on the right side or the left side depending on the user. The device is useful for anyone who may desire to put on their shoes with a shoehorn in a standing position or a sitting position without having to bend forward. The device may be particularly useful for people with physical conditions, impairments, or disabilities that make bending over or otherwise reaching for their shoes difficult.

The invention helps those who have difficulties inserting their feet into their shoes. The shoehorn has an attached offset long vertical handle. The offset handle can be mounted on the right side or the left side depending on either a right or left handed user. This allows the user to use the shoehorn in front of you. The long handle allows the user to stand. The offset allows for better visualization and less body movement. The wide saddle of the shoehorn makes it easy to maneuver over the back portion of the shoe. The back tab holds the back of the shoe while the front slide guide is inserted over the heel portion of the shoe making it easy to slide your foot into the shoe.

The handle located at the end of the vertically extending portion may be any type of handle or grip as would be recognized by those skilled in the art.

The device herein may be made of any suitable material. A non-exhaustive list of examples includes metal, would, plastics or other polymer-based materials, synthetic materials, in various suitable combinations thereof. The device is rigid in the preferred embodiment, however alternative embodiments may include more flexible materials provided a threshold level of rigidity is reached such that the device may be properly manipulated as a shoe horn.

The basic design of the device herein includes two shoehorn type pieces or tongues as shown, a vertically extending portion, and some type of grip or handle. In alternative embodiments the end portion of the vertically extending peace may be considered the handle portion as well.

The preferred embodiment is shown in the figures. This design is comprised of a double layered shoe horn portion attached to a short horizontally extending piece, which then turns at a 90 degree angle and becomes the essentially vertically extending piece. In the preferred embodiment the vertically extending piece is essentially straight, however in alternative embodiments shapes and arcs may be used. For example the vertically extending piece may have a slight inward or outward bowing or bend. The shape and path of the vertically extending piece is less important than the piece being of a certain threshold of rigidity. Additionally the 90 turn at the intersection of the horizontal support bar and the vertical support bar may be curved or polygonal in nature.

The dimensions of the device may vary provided it still is capable of carrying out its basic functions. The vertical length, horizontal length, thickness of the handle and extension, as well as the shape, contour, thickness, and length and width of the tongue shaped portions may all vary.

FIG. 1 shows a side view of the lower portion of the device. A front and back shoehorn type piece or tongue is shown where the back of a shoe would fit in between the two tongues. The two tongues are then connected to a vertically extending piece, a portion of which is shown as letter D. A is the shoehorn tongue which slides inside the back of the shoe. B is the second tongue which fits against the outside of the back of the shoe. The back portion of the shoes fits in between the two tongues in area C.

Figure 2:
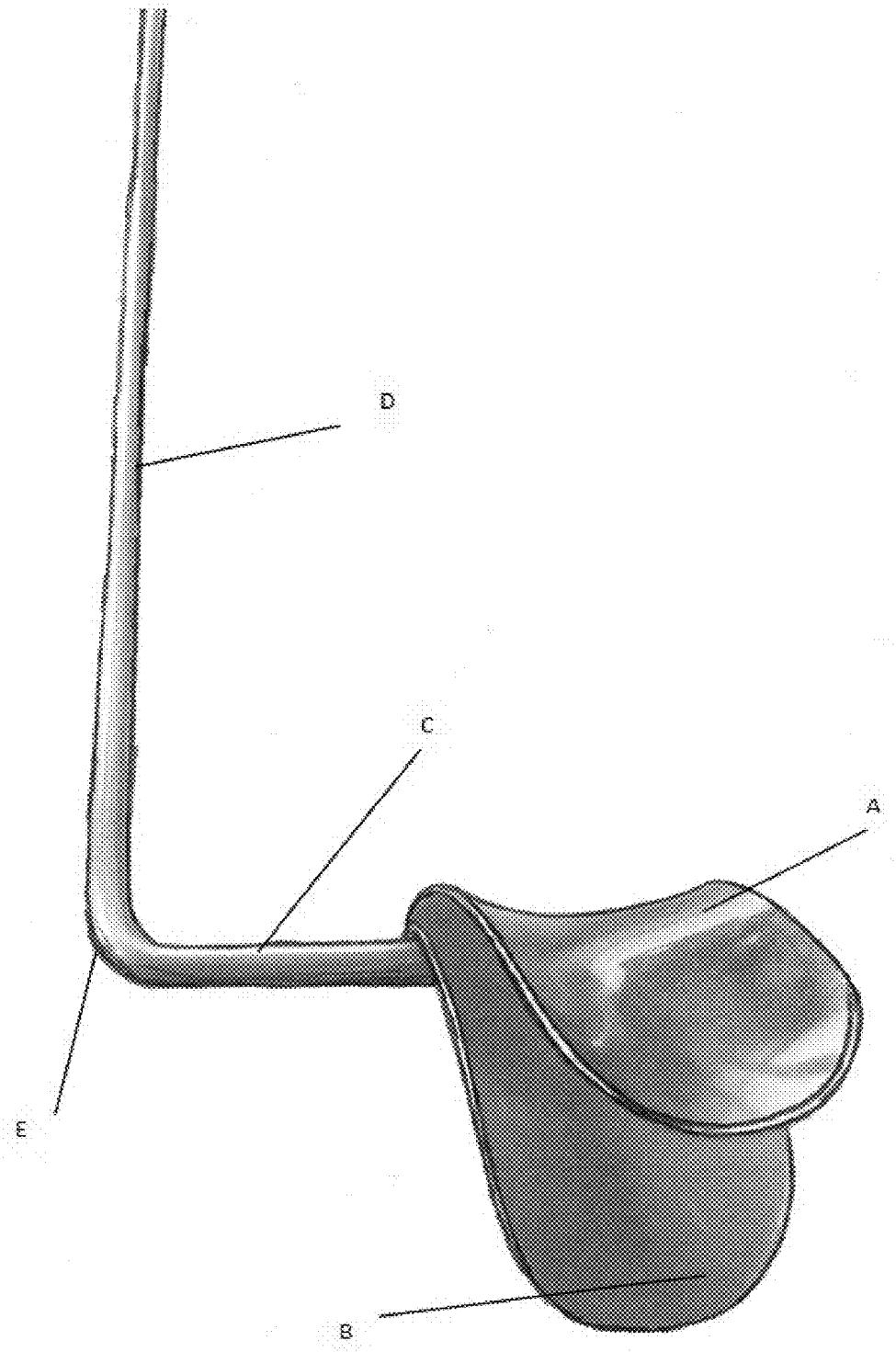
FIG. 2 shows the portion of the device as shown in FIG. 1 from a different angle. From this perspective the bottom of the device is shown, as is the horizontally extended portion which connects the two tongues with the vertically extending piece.

FIG. 2 shows the portion of the device as shown in FIG. 1 from a different angle. From this perspective the bottom of the device is shown, as is the horizontally extended portion which connects the two tongues with the vertically extending piece. A is the shoehorn piece or tongue that goes inside of the users shoe. B is the tongue portion that fits against the back of the shoe's exterior. C is the horizontally connecting piece. D is a portion of the vertically extending piece which may have a handle at the end. E refers to the angled portion between the horizontal and vertical pieces.

Figure 3:
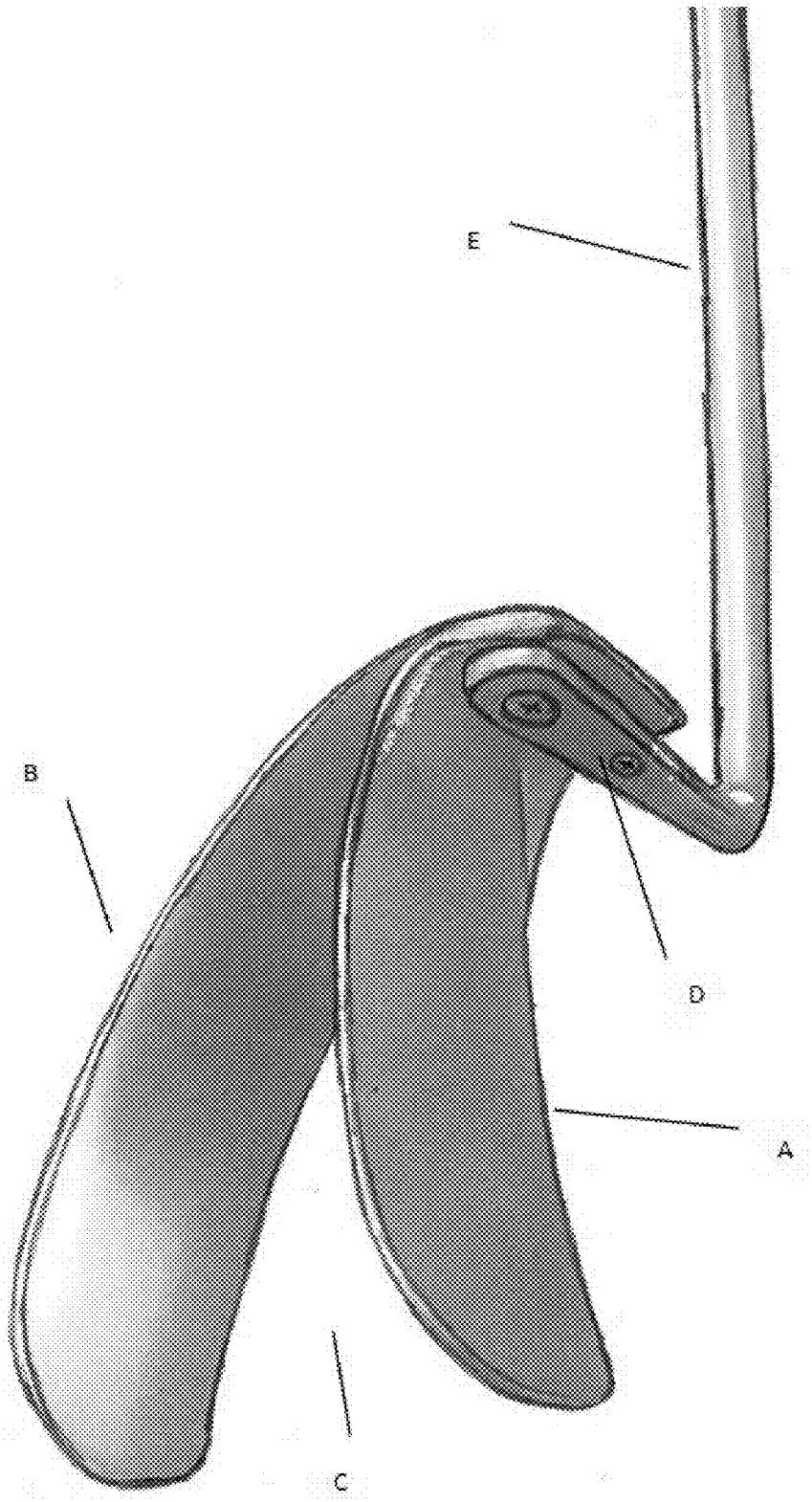
FIG. 3 shows the backside of the lower portion of the device.

FIG. 3 shows the backside of the lower portion of the device. A is the tongue fitting outside the shoe, B is the tongue or shoehorn fitting inside the shoe, and C is the space in which the back of the shoe is placed. Letter D refers to the portion of the horizontal piece that connects to the tongue devices. As shown two screws or bolts located on the underside connect the horizontal piece to the tongues. The horizontal piece then extends sideways and becomes the vertically extending piece E.

Figure 4:
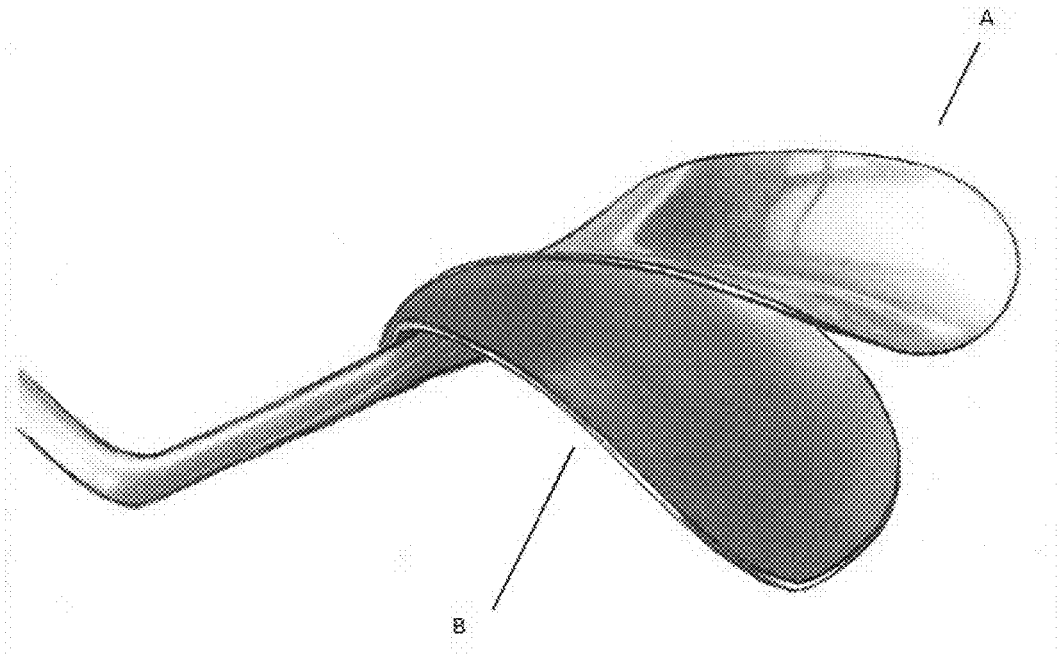
FIG. 4 shows the same lower portion as shown in the previous figures.

FIG. 4 shows the same lower portion as shown in the previous figures. FIG. 4 is particularly included however to show the contour and shape of the two tongue like devices, A and B. The tongue pieces are curved and concave to function as a shoehorn, to enable easily sliding ones foot into a shoe. In this figure the metallic nature of the material used is shown by the reflective appearance of A.

Figure 5:
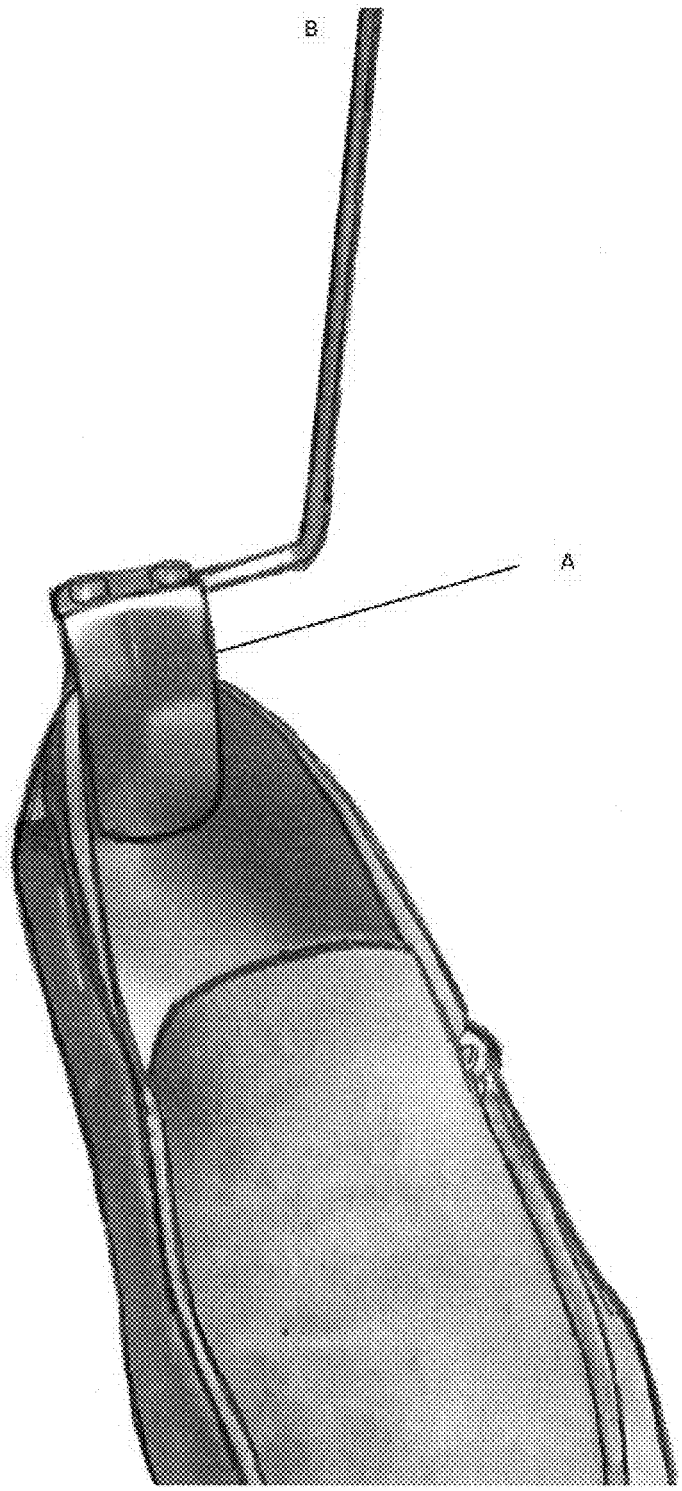
FIG. 5 shows the device inserted into a shoe for use.

FIG. 5 shows the device inserted into a shoe for use. A user's heal would slide down against the tongue surface shown (A) in this figure as a shoehorn is used. The vertical piece (B) extends upward to a handle portion whereby the user could slip on the shoe in a standing position.

Figure 6:
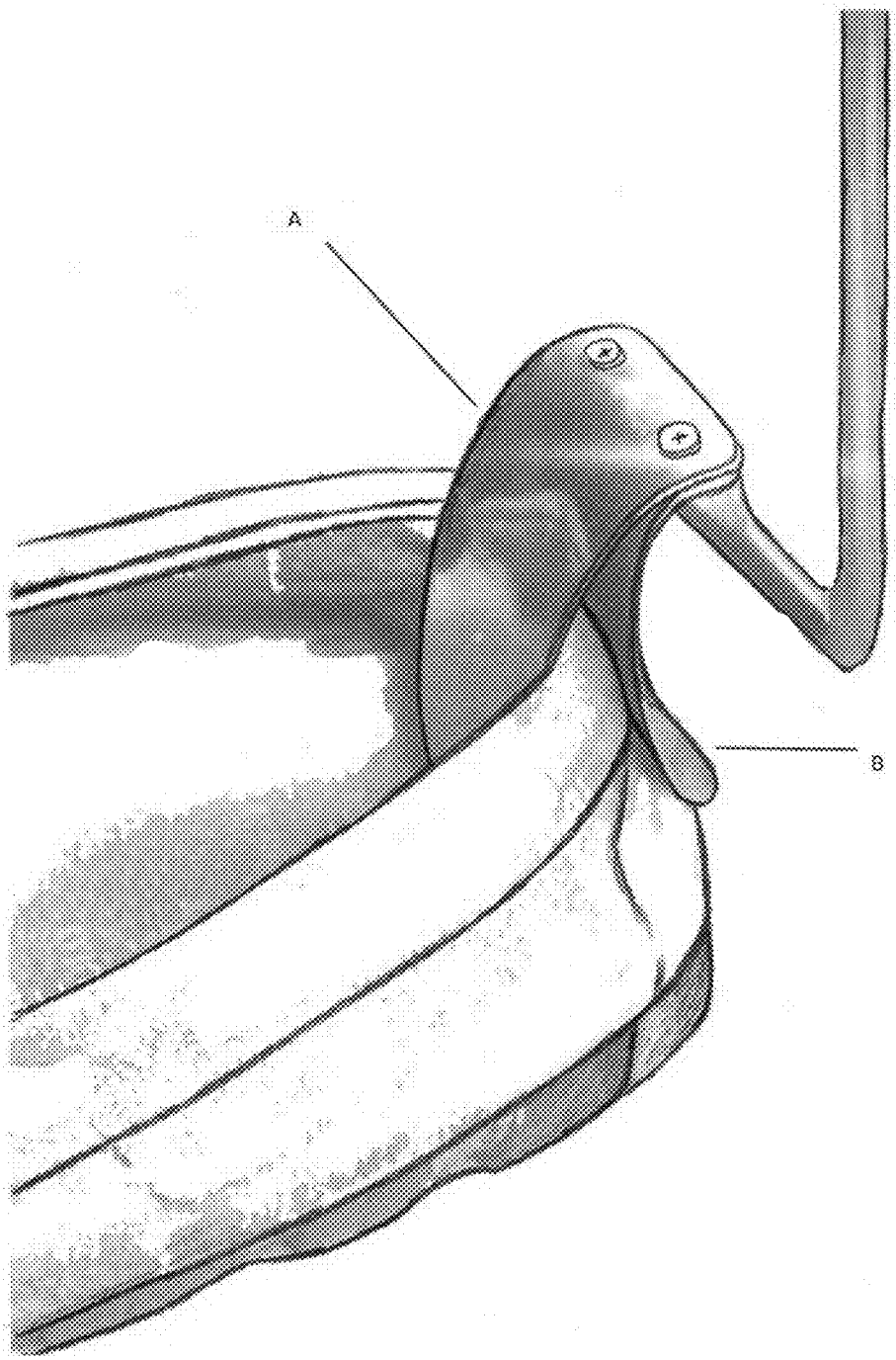
FIG. 6 shows the same use of the device shown in FIG. 5 from a side angle.

FIG. 6 shows the same use of the device shown in FIG. 5 from a side angle. The first tongue or shoehorn A fits inside the shoe. B fits on the exterior of the back of the shoe as shown.

Figure 7:
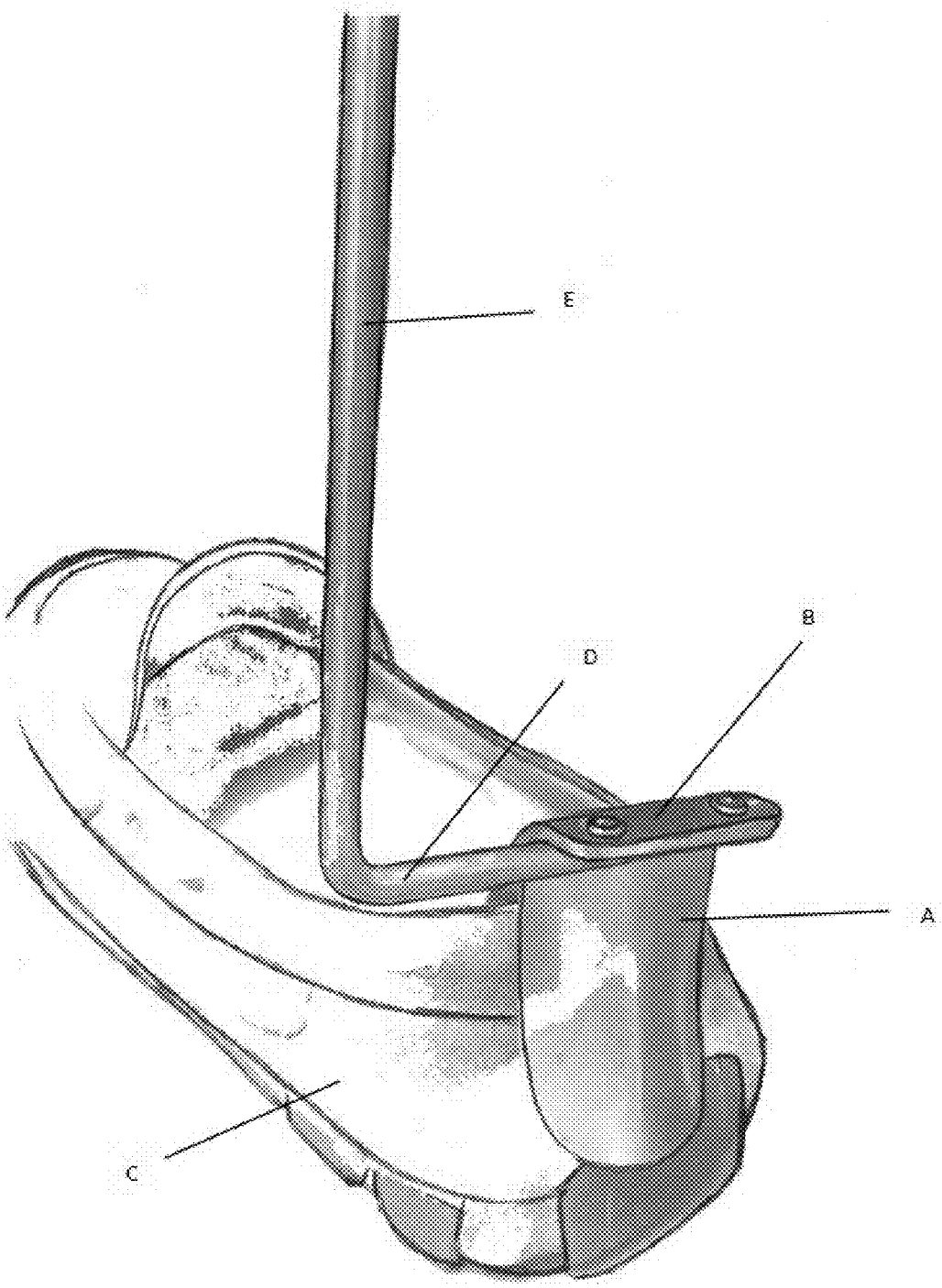
FIG. 7 shows the shoehorn device placed into a shoe for use from the rear angle

FIG. 7 shows the shoehorn device placed into a shoe for use from the rear angle. A is the exterior tongue placed against the back of the shoe. B is the portion of both tongues that connects to the horizontal piece D. C is the shoe. E is the vertical extending portion. E may extend upward to a handle section (not shown in this figure) located approximately around a user's hip, however may vary across the various embodiments.

Figure 8:
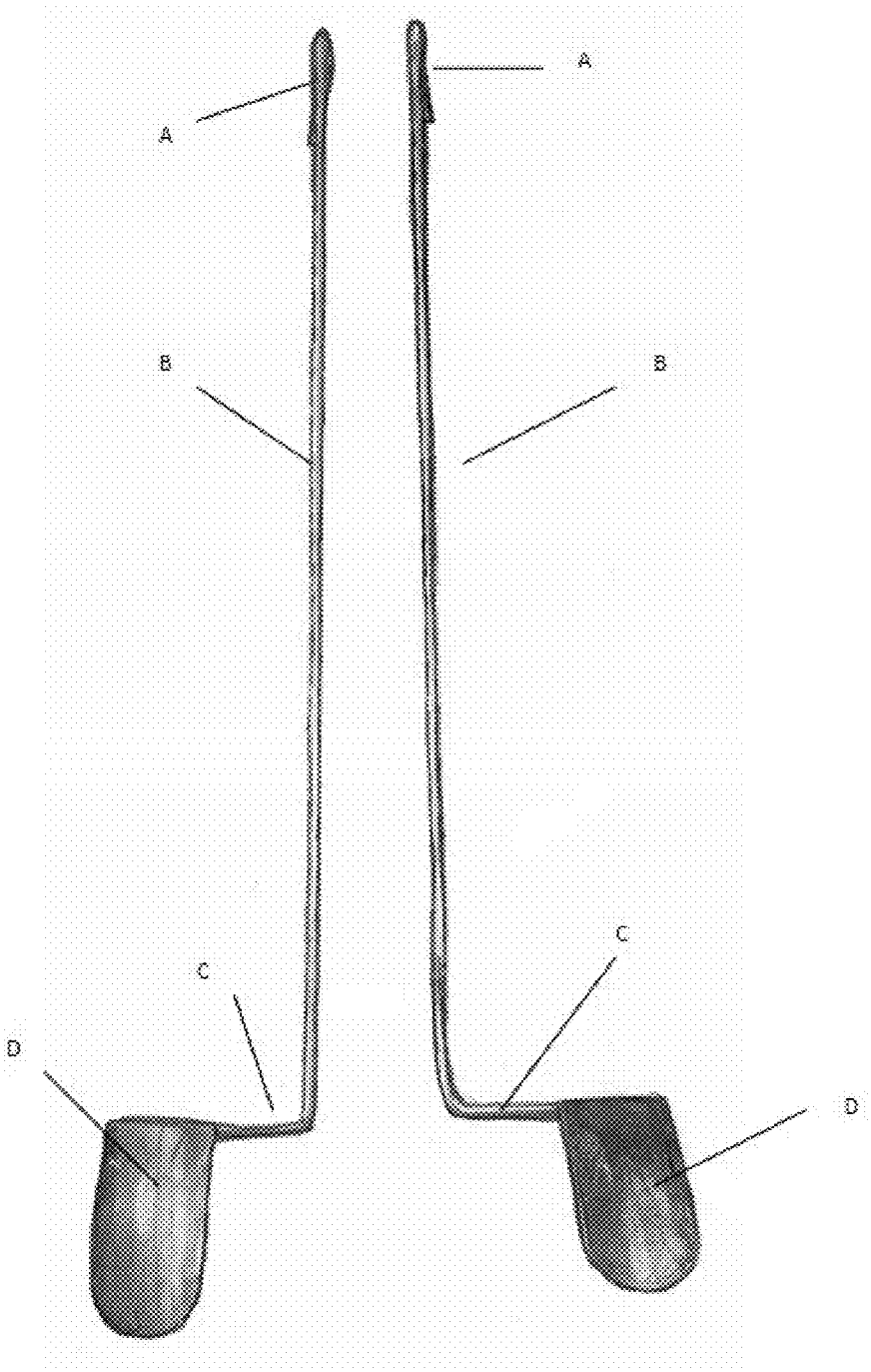
FIG. 8 shows a right and left handed version of the shoehorn device with its full length in view.

FIG. 8 shows a right and left handed version of the shoehorn device with its full length in view. Handles or grips, A, may be located at the top of the vertical piece B. Each device has a horizontally extending section, C, connected to the vertical section and the shoehorn portion D. In the preferred embodiment as shown in this figure the entire horizontal portion, vertical portion, and handle piece are made of a single metal bar that is bent at the places shown to make these components of the shoehorn device.

A shoehorn is known in the art and generally refers to curved and concaved tongue like structure that fits over the lip of a shoe, whereby a user may slide the heel of their foot along it for easy insertion into a shoe. Herein when used tongue or tongue device refers to the general curved and bent nature of the shoehorn or second tongue device shown in the figures. The second tongue like structure may in alternative embodiments not be tongue shaped but may be any type of downward extension.

The phrase "in one embodiment" is used repeatedly. The phrase generally does not refer to the same embodiment; however, it may. The terms "comprising," "having" and "including" are synonymous, unless the context dictates otherwise. The following illustrations of various embodiments use particular terms by way of example to describe the various embodiments, but this should be construed to encompass and provide for terms such as "method" and "routine" and the like.

Various aspects of the illustrative embodiments will be described using terms commonly employed by those skilled in the art to convey the substance of their work to others skilled in the art. However, it will be apparent to those skilled in the art that the embodiments described herein may be practiced with only some of the described aspects. For purposes of explanation, specific numbers, materials and configurations are set forth in order to provide a thorough understanding of the illustrative embodiments. However, it will be apparent to one skilled in the art that the embodiments described herein may be practiced without the specific details. In other instances, well-known features are omitted or simplified in order not to obscure the illustrative embodiments.

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, nor is it intended to be limiting as to the scope of the invention in any way. The characteristics and utilities of the present invention described in this summary and the detailed description below are not all inclusive. Many additional features and advantages will be apparent to one of ordinary skill in the art given the detailed description.

The invention claimed is:

1. A shoehorn device comprising:

A shoehorn connected to a second tongue device located behind the shoehorn with a space in between said shoehorn and said tongue device for insertion of a shoe's backstay;

A horizontal extension extending laterally on one side of the device connected to one or both of said shoehorn and second tongue, said extension horizontally offsetting said tongue from a vertical centerline; and A vertical extension connected to said horizontal extension, the horizontal extension being of sufficient length wherein the area of the tongue portion falls outside of the longitudinal plane of vertical extension, such that the vertical extension is to the side of the user during use.

2. The shoehorn device of claim 1 further comprising:

said horizontal extension between 1 and 7 inches in length;

said vertical extension between 12 and 48 inches in length; and said vertical extension terminating at the top with a handle structure.

3. Claim 1, wherein the vertical extension connecting to a handle is not located directly behind a user's foot or leg.

4. A shoehorn device comprising:

A shoehorn connected to a second tongue device located behind the shoehorn with a space in between said shoehorn and said tongue device for insertion of a shoe's backstay;

A horizontal extension extending laterally on one side of the device connected to one or both of said shoehorn and second tongue, said extension horizontally offsetting said tongue from a vertical centerline;

A vertical extension connected to said horizontal extension, such that the vertical extension is to the side of the foot during use;

said horizontal extension between 1 and 7 inches in length;

said vertical extension between 12 and 48 inches in length;

said vertical extension terminating at the top with a handle structure; and wherein the shoehorn and second tongue device are secured to the horizontal extension by two screws that pass through the top end of the shoehorn and second tongue device and into a flattened portion of the horizontal extension.

5. The shoehorn device of claim 4, wherein the horizontal extension and vertical extension form a single piece bent at a 90 degree angle in between the horizontal and vertical portions.

6. The device of claim 5, the device being made from any of metal, wood, plastic, polymer based materials, or synthetic materials.

7. The shoehorn device of claim 5, wherein the offset handle allows for stepping forward into a shoe during use.

8. A first tongue device located in front of a second tongue device, both secured at the top to a horizontal bar offsetting the tongue from a vertical centerline, said horizontal bar extending out horizontally for 1 to 7 inches, then turning a 90 degree angle in an upward direction and vertically extending for 12 to 48 inches and culminating with a handle structure at it's top, wherein the horizontal extension is of sufficient length such that the area of the tongue portion falls outside of the longitudinal plane of vertical extension.

9. The device of claim 8, further comprising a space between the shoehorn and the second tongue device is large enough to accept the backstay portion of a shoe.

10. The device of claim 9, the device being made from any of metal, wood, plastic, polymer based materials, or synthetic materials.

11. The shoehorn device of claim 10 wherein the offset handle allows for stepping forward into a shoe during use.

12. Claim 8, wherein the vertical extension connecting to a handle is not located directly behind a user's foot or leg.

13. A shoehorn device with an offset handle allowing for stepping forward into a shoe during use, wherein said offset the horizontal extension being of sufficient length wherein the area of the tongue portion falls outside of the longitudinal plane of vertical extension, such that the vertical extension is to the side of the user during use.

* * * * *